United States Patent [19]

Anspach

[11] Patent Number: 4,706,338

[45] Date of Patent: Nov. 17, 1987

[54] APPARATUS FOR FORMING FIBRE WEBS

[75] Inventor: Jean M. H. Anspach, São José dos Campos, Brazil

[73] Assignee: Chicopee, New Brunswick, N.J.

[21] Appl. No.: 839,019

[22] Filed: Mar. 12, 1986

[30] Foreign Application Priority Data

Mar. 12, 1985 [BR] Brazil ..... 8501093

[51] Int. Cl.[4] ..... D01G 15/40; D01G 15/46

[52] U.S. Cl. ..... 19/105; 19/106 R; 19/145.7; 19/302; 19/304

[58] Field of Search ..... 19/145.5, 145.7, 302, 19/106 R, 105, 304

[56] References Cited

U.S. PATENT DOCUMENTS

| | | | |
|---|---|---|---|
| 2,086,592 | 7/1937 | Williams | 19/145.5 X |
| 3,616,180 | 10/1971 | Newman | 19/302 X |
| 4,475,271 | 10/1984 | Lovgren et al. | 19/145.7 X |
| 4,519,201 | 5/1985 | Toon | 19/145.5 X |

FOREIGN PATENT DOCUMENTS

| | | | |
|---|---|---|---|
| 0962162 | 7/1964 | United Kingdom | 19/106 R |

*Primary Examiner*—Louis K. Rimrodt

[57] ABSTRACT

An apparatus for forming fibre webs including a first component and a second component in the form of two textile fibres differentiated by their average fibre length or a textile fibre and wood pulp, said apparatus including a card means having a discharge zone, means for feeding said second component to said discharge zone, and means for condensing the fibres in said discharge zone whereby a highly uniform fibre web is obtained.

4 Claims, 1 Drawing Figure

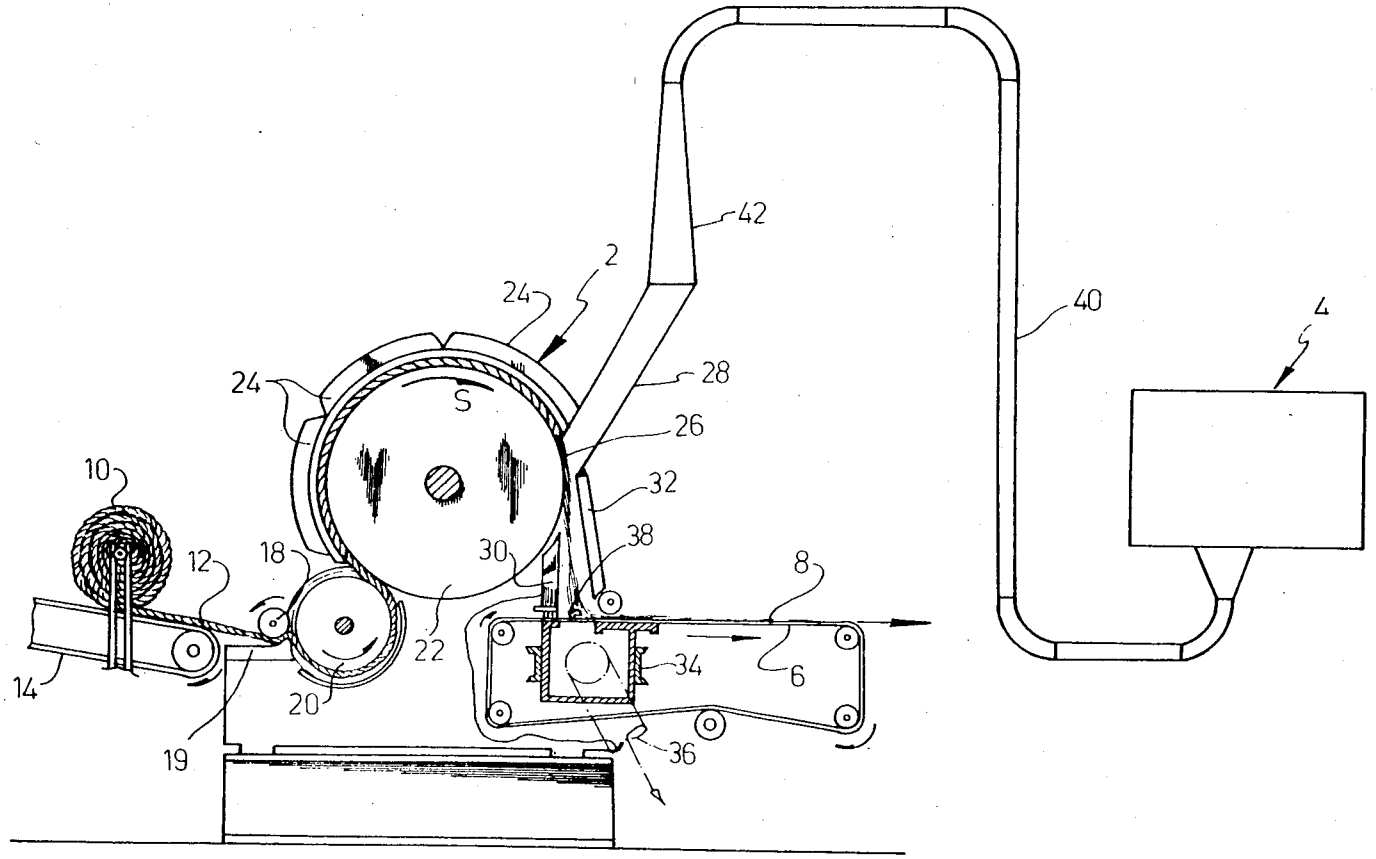
4
40
42
28
26
32
38
2
24
S
30
22
8
6
34
36
24
18
20
12
19
10
14

APPARATUS FOR FORMING FIBRE WEBS

The present invention refers to an apparatus for forming fibre webs, and more specifically to such an apparatus particularly suitable for forming fibre webs comprising intimately bonded textile fibres and wood pulp.

Typically, in the manufacture of non-wovens, fibre webs comprising groups of loose fibres are submitted to various processes for bonding, re-distributing and/or interconnecting the fibres. The quality of the non-wovens is intimately related to the quality of the fibre web feed. Thus, the weight, fibre orientation and product uniformity are functions of the corresponding properties of the fibre web.

Homogeneous fibre webs can presently be formed at elevated production velocities. However, fibre webs prepared from two or more different types of fibre or from a fibre mixed with wood pulp have to be manufactured according to less developed manufacturing techniques in which the web production velocity is relatively low, this having a significant influence on the cost of the final product.

The object of the present invention is to eliminate this drawback of the prior art by providing an apparatus for forming heterogeneous fibre webs comprising at least two different types of fibres or textile fibres mixed with wood pulp, at high production velocities.

The invention comprises a combination of elements each of which may be optimized to carry out its main function or functions in an effective and efficient manner so that the invention may be used to produce heterogeneous fibre webs of a quality at least as high as in homogeneous fibre webs that may be produced by prior art techniques and, at the same time, heterogeneous webs of high quality produced at production rates that could not be reached in the prior art.

According to the present invention, this object is obtained by providing an apparatus for forming fibre webs including first and second components in the form of at least two textile fibres differentiated by their average fibre lengths or a textile fibre and wood pulp, characterized by comprising card means having a discharge zone, means for feeding said second component to said discharge zone and means for condensing the mixed fibres in said discharge zone, whereby a highly uniform fibre web is obtained.

The present invention will now be described, by way of a non-limiting example, that refers to a specific embodiment illustrated in the drawing.

The single FIGURE is a schematic view of the different devices constituting the apparatus.

Referring now more particularly to the drawing, one embodiment of an apparatus for forming heterogeneous fibre webs at elevated production velocities basically comrpises a high velocity card means 2 and a pulp mill 4 coupled so as to deposit intimately mixed textile fibres and wood pulp on a conveyor belt 6 to form a fibre web 8.

A rotatably mounted roll 10 comprising a tow of cut fibres 12 is fed by a conveyor belt 14 which leads fibres 12 from roll 10 to the fibre web forming apparatus generally indicated by reference number 2.

Fibres 12 are led by conveyor belt 14 to a feed cylinder 18 which regulates the feed of the fibres by means of a guide bar 19 to a rotatable take-up roll 20 which is specially constructed to separate the fibres of the feed tow 12. The separated fibres are then fed to a cylinder

22 which rotates in the direction of arrow S and whose surface is covered with specially configured teeth to co-operate with comb means 24 to separate the fibres.

The separated fibres leaving roll 20 are led on to the surface of a main cylinder 22 through stationary card elements 24 equipped with teeth adapted to co-operate with the toothed surface of main cylinder 22 to individualize the fibres as they are led through the stationary card elements 24 to a discharge zone, generally indicated by reference number 26 in the FIGURE.

When the fibres reach the discharge zone 26, they are individualized and form a thin uniform layer from one side to the other of the width of cylinder 22. In discharge zone 26, the fibres are discharged in a current of air which passes through a duct defined by the surfaces of a deflector plate 28, a doctor blade 30, a duct front 32 and said plates (not shown).

Deflector plate 28 is part of a rectangular cross section duct, the purpose of which will be described below.

The current of air in the discharging zone is created by a vacuum box 34 arranged below the continuous foraminous conveyor belt 6 in the region corresponding to the discharge zone 26, and connected to a suction fan (not shown) by means of a duct 36. The positioning of the vacuum box 34 with respect to the discharge zone 26 creates a web condensing zone 38 in which web 8 is deposited om belt 6.

The pulp mill 4 is provided with a discharge duct 40 whose opposite end is connected to a hood 42, in its turn connected to the above-mentioned rectangular duct 28. This arrangement permits the reduced pressure in discharge zone 26 to suck the ground pulp from mill 4 to the condensing zone 38 where the pulp and the textile fibres are deposited on the conveyor belt. The fibre web forming apparatus of the present invention enables the obtention of a highly uniform mixture of pulp and fibres whereby the formed web does not include regions of higher or lower concentrations of either of its components.

Although the present invention has been specifically described with respect to the formation of a heterogeneous fibre web constituted by textile fibres and wood pulp, it is clear that the apparatus of the invention may also be used for forming heterogeneous fibre webs containing reduced length textile fibres. In such a case a fan may be used to assist in conveying the short fibres to air duct 40.

In view of the above description of the present invention, it will be understood that various different embodiments may be constructed provided that the modifications do not depart from the spirit and scope of the invention defined in the amended claims.

I claim:

1. Apparatus for forming fibre webs including first and second fibrous components in the form of at least two textile fibres differentiated by their average fibre length or a textile fibre and wood pulp, comprising a card means for individualizing said first fibrous component, said card means having a rotating cylinder for delivering individualized fibres of said first fibrous component to a discharge zone adjacent to the periphery of said rotating cylinder; air flow means for directing a flow of air to the peripheral surface of the rotating cylinder at the discharge zone and in a direction concurrent with the direction of rotation of the cylinder at the discharge zone, to discharge said first fibrous component into said air flow in the discharge zone; means separate and apart from said card means for individualizing said second fibrous component; duct means for transporting individualized fibres of said second fibrous component, said duct means having an outlet adjacent the periphery of said rotating cylinder to feed individualized fibres of said second fibrous component to said discharge zone; and means adjacent to said discharge zone and in the path of said air flow means for condensing the fibres mixed in said discharge zone whereby a highly uniform fibre web is produced including individualized fibres from said first and second fibrous components.

2. Apparatus according to claim 1 in which said card means comprises a toothed main cylinder co-operating with stationary card elements for feeding individualized fibres to said discharge zone.

3. Apparatus according to claim 1 in which said second fibrous component is fed to said discharge zone through a duct opening to the discharge zone and mounted on a hood connected to a pulp mill by an air duct.

4. Apparatus according to claim 1 in which said condensing means comprises a vacuum box arranged below a foraminous conveyor belt in a region corresponding to said discharge zone.

* * * * *